US005952915A

United States Patent [19]

Marquardt et al.

[11] Patent Number: 5,952,915

[45] Date of Patent: Sep. 14, 1999

[54] SIGNAL PILLAR

[75] Inventors: Erich Marquardt, Rietheim-Weilheim; Udo Goetz, Trossingen, both of Germany

[73] Assignee: Werma-Signalgeraete GmbH & Co., Rietheim-Weilheim, Germany

[21] Appl. No.: 08/722,063

[22] PCT Filed: Apr. 13, 1995

[86] PCT No.: PCT/DE95/00521

§ 371 Date: Oct. 10, 1996

§ 102(e) Date: Oct. 10, 1996

[87] PCT Pub. No.: WO95/28598

PCT Pub. Date: Oct. 26, 1995

[30] Foreign Application Priority Data

Apr. 15, 1994 [DE] Germany ..... 44 12 937

[51] Int. Cl.[6] ..... G08B 5/00

[52] U.S. Cl. ..... 340/332; 340/815.15; 340/432; 340/463; 362/157; 362/183

[58] Field of Search ..... 340/332, 815.4, 340/815.49, 815.15, 815.73, 642, 815.45, 432, 463; 362/196, 197, 199, 202, 204, 205, 263, 183, 157

[56] References Cited

U.S. PATENT DOCUMENTS

| | | | |
|---|---|---|---|
| 3,868,671 | 2/1975 | Maguire et al. | 340/323 R |
| 4,527,158 | 7/1985 | Runnels | 340/961 |
| 4,931,766 | 6/1990 | Bernard et al. | 340/332 |
| 5,057,815 | 10/1991 | Smoot et al. | 340/468 |
| 5,453,729 | 9/1995 | Chu | 340/332 |

FOREIGN PATENT DOCUMENTS

| | | |
|---|---|---|
| 2517021 | 5/1983 | France . |
| 2211801 | 9/1972 | Germany . |
| 101482 | 11/1973 | Germany . |
| 90 10 187 U | 10/1990 | Germany . |

*Primary Examiner*—Edward Lefkowitz
*Assistant Examiner*—Davetta Woods
*Attorney, Agent, or Firm*—Venable; George H. Spencer

[57] ABSTRACT

A signal pillar includes a plurality of signal elements (2, 2') which are identical in their design and are arranged one on top of the other. In order to achieve simple and effective mechanical and electrical connection, a bayonet closure arrangement (13) is provided between the signal elements (2, 2') and an electrical connection base (3), and connection between respectively adjacent components are made by connecting wires having L-shaped legs (31) and U-shaped connecting bridges (27).

24 Claims, 3 Drawing Sheets

SIGNAL PILLAR

BACKGROUND OF THE INVENTION

The invention relates to a signal pillar of the type having a plurality of signal elements which are essentially identical in design, which are arranged one on top of the other, and which are connected to one another by means of a closure connection or the like.

The German laid-open application 22 11 801 has disclosed a signal pillar of the generic kind, which comprises a plurality of light elements which are of identical design and which can be combined without the aid of special tools. Here, the known signal pillar can be taken apart at any desired point so that it is easy to replace incandescent bulbs.

The known signal pillar has an electrical coupling device so that adjacent light elements can be connected to one another electrically by means of a relative, limited rotation. Furthermore, during this rotation the two light elements are connected mechanically as a result of an interaction of two connecting elements. In this context, a dividing wall between two light elements and a transparent hood are rotated with respect to one another, a screw-kind closure, a bayonet closure or else other kinds of closure being mentioned as connecting devices. The electrical connection between adjacent light elements is made by means of an electrical coupling which has complementary coupling areas such as sockets and plugs so that plugging two light elements one on top of the other causes the feed lines of the light elements to be connected.

This known device has the disadvantage that the dividing wall between the light elements and the transparent hood are of multi-piece construction and have to be screwed or connected to one another. Here, the connection of the dividing wall and hood must simultaneously bring about the connection of the electrical terminals, for which reason an electrical connecting element which is of complicated design is provided as a feed line. In particular, in order to receive the plug of the feed line, an elastic bushing has only two legs which are sprung with respect to one another and are not capable of ensuring reliable contact between the plug and bushing.

SUMMARY OF THE INVENTION

The invention is based on the object of proposing a signal pillar or light pillar which does not have the previously mentioned disadvantages and which has in particular a highly efficient means of making electrical contact between the signal elements which are arranged in a row. It is also to be possible to disconnect the signal elements easily at any desired point of the signal pillar so that signal transmitters or individual signal elements of different colors can be replaced. It is also an object to make the signal pillar versatile in terms of its possible applications. Furthermore, a simple and expedient housing connection between the individual signal elements is to be obtained.

The signal pillar according to the invention has the advantage that a very efficient electrical connection can be produced between the individual signal elements. Here, the individual electrical feed lines are produced in particular from simple round wires which are constructed at one end in a U shape as a connecting bridge while the other end of the electrical connecting line which is constructed as a round wire is merely preferably bent into an L shape and serves to make electrical contact with the U-shaped connecting bridge of the adjacent signal element. As a result, an electrical connection which is of very simple design but highly efficient in terms of its effect is provided between the individual signal elements. The U-shaped connecting bridge ensures a high degree of stability of the electrical connecting element but, in the simplest embodiment, a connecting bridge which is merely pin-shaped may be used.

The construction of each signal element for producing a signal pillar by means of a pot-shaped arrangement of a cylinder component with baseplate which is integrally connected thereto is particularly advantageous, the cylindrical components being placed one inside the other with a corresponding inner and outer flange and being rotatably connected to one another by means of a bayonet closure. In this arrangement, axial prestressing occurs as a result of a specific seal according to the invention as well as a result of corresponding run-up slopes and locking as a result of corresponding locking noses with positively locking depressions. As a result, a secure and selectively frictionally locking and positively locking mechanical connection is brought about between two adjacent signal elements. At the same time as the mechanical connection, the U-shaped connecting bridges are also connected electrically to the associated wire ends, the contacting components sliding against one another in a frictionally locking and resiliently sprung fashion.

Further details of the invention and in particular additional information on preferred refinements of the invention emerge from the following description and the appended drawing. Of course, the features mentioned above and those still to be explained below can be used not only in the respectively given combination but also in another combination or alone without departing from the scope of the present invention. In particular, different kinds of signal elements may be used.

DESCRIPTION OF THE PREFERRED EMBODIMENTS

Figures 1, 2A, 2B:
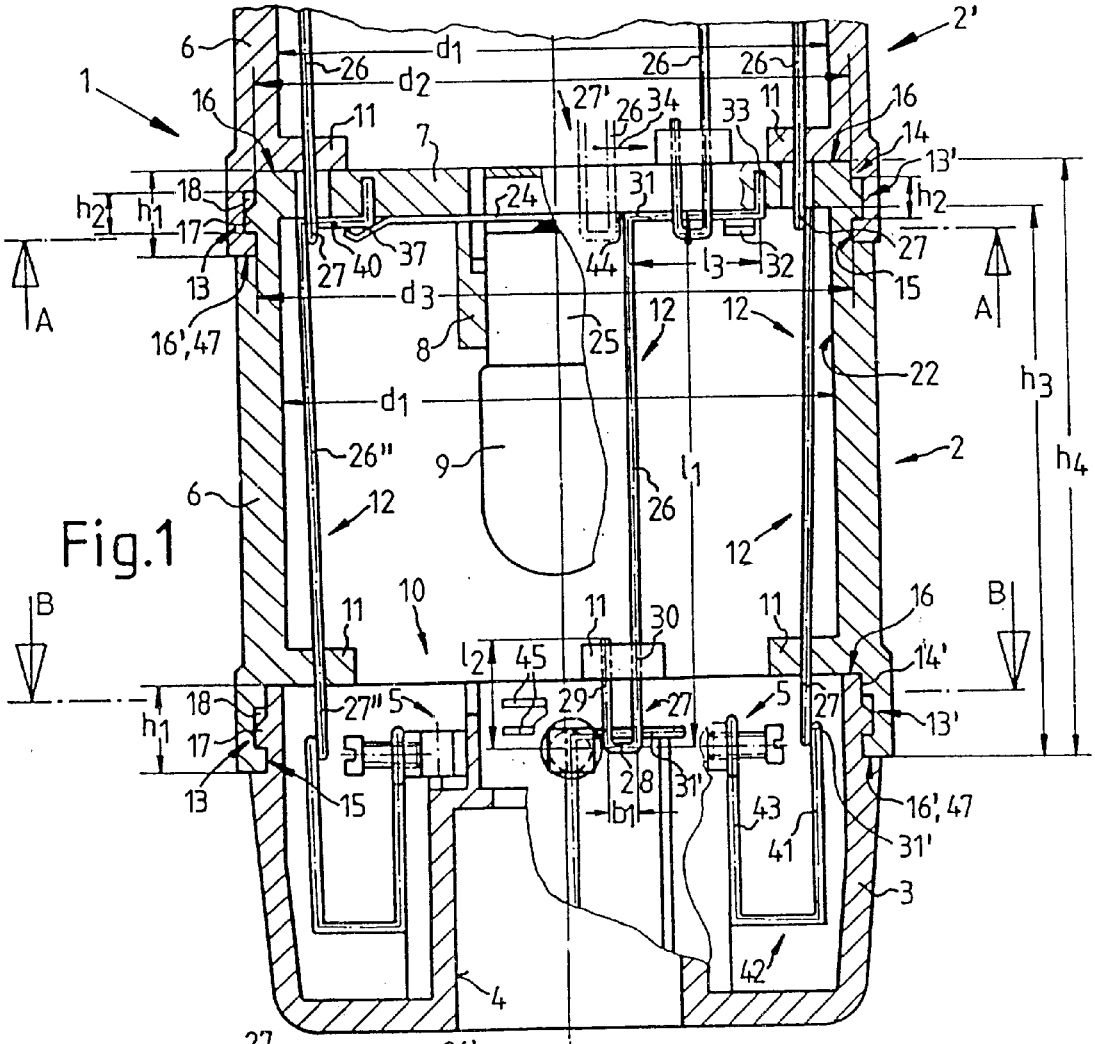
FIG. 1 shows a longitudinal section through a first exemplary embodiment with a light element with a further light element fitted onto it in a partial view and with a base fitted on at the bottom.
FIG. 2*a* shows a section along the sectional line 2*a*—2*a* in FIG. 1
FIG. 2*b* shows a section along the sectional lines 2*b*—2*b* in FIG. 1.

The signal pillar which is illustrated in longitudinal section in FIG. 1 and in cross-section in FIG. 2 is constructed as a light pillar 1 and comprises a plurality of light elements 2 which are arranged one on top of the other and are of identical mechanical design. In FIG. 1, in particular a lower light element 2 is connected to a light element 2' located on top of it. As many such light elements as desired may be arranged one on top of the other. A cable connection base 3 which has a central hole 4 for receiving a connection cable (not illustrated in greater detail) and whose individual wires are attached to screw terminals 5 is used as the lower termination in FIG. 1.

Each light element 2, 2' etc. comprises a pot-shaped housing with in each case one transparent or translucent, cylinder component 6 which may be of various colors. The cylinder component 6 is closed off on one side by means of a baseplate 7 which is integrally connected to it and is fitted with a holder 8 for receiving for example an incandescent lamp 9 with lamp base 25. Instead of an incandescent lamp 9, the holder may also have a large number of other visual or audible Signal transmitters, such a flashing light, flashlight, buzzer, horn or the like, for example.

The lower part of the cylinder component 6 is provided with an opening 10 which extends over the entire internal diameter $d_1$, radially inwardly directed mounting webs 11 projecting into the opening 10 in order to fix the electrical connecting lines 12 at individual points. These electrical connecting lines 12 comprise a round wire which is approximately 1 to 1.5 mm thick and is bent and guided in accordance with the illustration in FIGS. 1 and 2, as will be explained later.

The connection of the signal elements or light elements 2, 2' to one another and the connection of the current connection base 3 is made via a bayonet connection 13, 13' with corresponding connecting flanges. For this purpose, each light element 2 has, in the region of its baseplate 7, an outer flange 14 which runs around cylindrically and has an external diameter $d_2$ which interacts with a cylindrical inner flange IS with an internal diameter $d_3$ in the opening region 10 of the adjacent component 2'. The internal diameter $d_3$ is identical to, or only slightly larger than, the external diameter $d_2$, so that the light elements 2, 2' can be pushed one into the other over a vertical section $h_1$ in a positively locking fashion. Since the internal diameter $d_1$ of the light elements 2, 2' is smaller than the external diameter $d_2$ of the outer flange 14, the outer flange 14 is supported on a circumferential, radial annular shoulder 16 with the diameter $d_2$–$d_1$. Furthermore, the outer flange 14 may be partially supported on the mounting webs 11. In the same way, the lower part of the inner flange 15 can also be supported on a lower annular shoulder 16' of the outer flange 14, the sealing arrangement 46 described with respect to FIG. 3 being preferably used.

The bayonet closure 13, 13' between the light elements 2, 2' and between the light element 2 and the lower base 3 is formed by means of a customary radially protruding guide nose 17 on the cylindrical outer flange 14 on the light element 2 and on the outer flange 14' on the electrical connection base 3, the said guiding nose 17 being initially guided axially into an axial groove 18' on the inner flange 15 and then engaging in a tangential groove 18 which extends over a rotary angle range $\alpha 1$ of 30°. The tangential groove 18 is of slightly rising construction toward its closed end, so that axial drawing together occurs during the rotational movement of the bayonet connection. During this process, a sealing arrangement 46 described with respect to FIG. 3 counteracts this axial pressure. There are, for example, three such bayonet closures on the circumference of the connecting flanges 14, 15.

In order to avoid undesired opening of the bayonet closures, the flange connection 14, 15 also has a combined positively locking and frictionally locking connecting element as a specific and additional bayonet closure 13'. In the case of this bayonet closure 13', a is bulging section 19, which extends over approximately the entire height $h_2$ of the bayonet connection, is directed radially inward and has an oblique run-up slope 20, is provided. These components 19, 20 are arranged on the inner flange 15 of the respective light element 2, 2'. A radially outwardly directed cam 21 which is V shaped in plan view and is located on the outer flange 14 or 14' interacts with this slope-like surface section 19, 20. So that the cam 21 can move radially inward over the run-up slope and then outward again into the position in accordance with FIG. 2*a,* the cam 21 is bounded in the upper and lower regions by two horizontal tangential slots 45 which penetrate the entire wall thickness s of the outer flange 14 so that the cam 21 can spring radially inward and outward. In FIG. 2*a,* the cam is represented in its starting position during the axial pushing together of the components by position 21'. This cam 21' runs over the run-up slope 20 in a radially inward movement over the bulge 19 and then arrives in the radially outer position 21. As a result, the bayonet connection is closed in a frictionally locking fashion with positively locking engagement. The bayonet closures 13, 13' both connect the light elements 2, 2' etc. to one another and connect the last light element 2 to the associated cable connecting base 3.

The electrical connecting lines 12 are constructed as follows:

In the region of the inner wall 22 of the cylinder component 6 there are for example six electrical connecting lines 12 with angular spacing of 60°, serving as feed lines. Two of these connecting lines 12', 12" serve in each case in each light element 2, 2' for connecting to the conductor lugs 23, 24 which lead to the holder 8 and thus to the lamp base 25 of the incandescent lamp 9 or the like.

The other electrical connecting lines 12 serve for connecting the electrical current to the downstream light elements which can be switched independently of one another and for the electrical connection of the cable connecting base 3.

As FIG. 1 shows, each electrical connecting line 12 comprises a round wire with a first longitudinal section 26 with the length $l_1$ which extends over virtually the entire height $h_3$ of the interior of the cylinder component 6. The entire height of the light element 2, 2' is designated by $h_4$. The difference formed by $h_4$–$h_3$ gives the thickness of the baseplate 7.

In the lower region, the longitudinal section 26 is bent over to form a U-shaped connecting bridge 27 with a lower horizontal connecting leg 28 which is directed outward somewhat tangentially, has the width $b_1 \cong 5$ mm and is adjoined by the upwardly bent wire leg 29 with a length $l_2$. The length $l_1$ is approximately $l \cong 60$ mm and the length $l_2$ is approximately $l_2 \cong 12$ mm. The upper end of the wire leg 29 is securely embedded in the mounting web 11. The section 30 of the longitudinal section 26 which lies parallel hereto lies with radial play within this mounting web 11.

The electrical connecting line 12 is bent over at a right angle at its other end lying at the top in FIG. 1 (corner 44) and forms an L-shaped leg 31 with the length $l_3 \cong 20$ mm. This leg 31 which is bent at a right angle runs approximately tangentially within the inner wall 22 and is clamped in with a supporting web 32 between the wall 22 and supporting web 32 in a positively locking fashion. Furthermore, the L-shaped leg 31 is bent over at a right angle in an end section 33 and secured in the baseplate 7.

The light elements 2, 2' are joined by axially pushing together the bayonet connection with subsequent rotation. During the axial pushing together, the U-shaped connecting bridge 27 moves into a position 27', as is indicated in FIG. 1 by dot-dash lines between the light elements 2, 2'. In this case, the longitudinal section 26 of the connecting bridge 27' is located right next to the corner 44 of the L-shaped leg 31 which is bent over at a right angle, and it slides in the direction of the arrow 34' onto the L-shaped leg 31 as a result of the rotary movement of the bayonet closure, as illustrated in FIG. 1. Here, the L-shaped leg 31 is pressed outward in the direction of the inner wall 22, by the radially outwardly acting pressing force of the U-shaped connecting bridge 27, so that the slightly oblique position of the longitudinal section 26 in FIG. 1 is obtained. At the same time, the U-shaped bridge 27 is bent radially inward so that a frictionally locking connection of the two supporting legs of the connecting bridge 27 to the wire leg 31 is obtained.

As FIG. 2*a* shows, the U-shaped connecting bridge 27 always bears radially against the L-shaped leg 31 on the inside. In the starting position 27', the lower connecting leg 28 is not aligned exactly flush with the L-shaped leg 31 but is rather positioned angled slightly inward so that this component can slide onto the L-shaped leg 31 without difficulty.

The baseplate 7 has cutouts 34 for passage of the U-shaped connecting bridges 27' which are adjoined laterally by tangential slots to carry out the swivelling movement or rotary movement as the components close.

The electrical connection of the conductor lug 23 (see FIG. 2*a*) is made via the electrical connecting line 12' which comes from below in each case (from the base 3) in FIG. 1 and leads via the obliquely downwardly leading longitudinal section 26' and an angled, horizontal section 36 to an attachment claw 37. The attachment claw 37 is electrically connected to the conductor lug 23. The horizontal section 36 is led on via a Z-shaped deflection section 38 on the inner wall to the U-shaped connecting bridge 27' which leads to the associated or corresponding lamp terminal of the downstream light element 2'. The conductor lugs 23 are consequently electrically connected in series, an offset by the rotary angle $\alpha$1 being present in each case. The end of this wire section 39 is held in turn by means of the support web 32 and the embedded end section 33.

The second conductor lug 24 is also connected via an attachment claw 37 to a horizontal wire section 40 which, in FIG. 1, leads downwards in a longitudinal section 26" to a U-shaped connecting bridge 27". The conductor lug 24 of the downstream light element is then supplied with power by the electrical connecting line 12 which is arranged offset by the rotary angle $\alpha$1.

The design of the electrical cable connecting base 3 is illustrated in FIG. 1 and FIG. 2*b*. Firstly, the light element 2 is connected to the base 3 by an identical bayonet closure connection 13', the U-shaped connecting bridges 27 which project downward into the inner flange of the light element 2 sliding over horizontally and tangentially aligned L-shaped legs 31'. As a result, there is also flat and frictionally locking contact between the two U-shaped legs of the connecting bridge 27 and the connecting wire 31'.

A U-shaped power supply wire 42 has a downwardly leading wire section 41 and a wire section 43 that is connected to a screw terminal 5. From here, an electrical connecting wire (not illustrated in greater detail) is attached to for example six screw terminals 5.

Figure 3B:
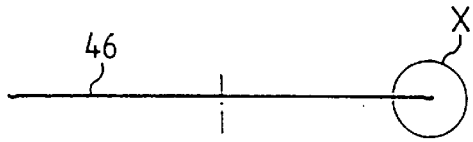
FIGS. 3*a*–3*d* show a more detailed illustration of a sealing arrangement between two signal elements.
Figure 3C:
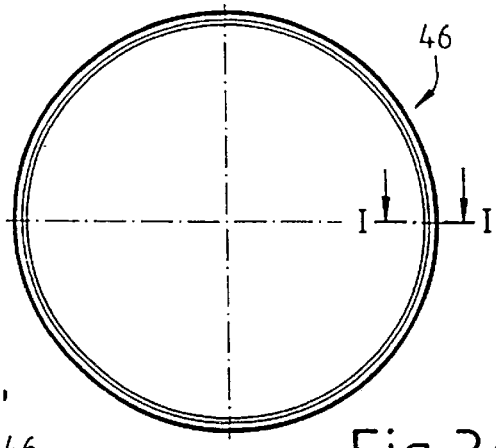
Figure 3A:
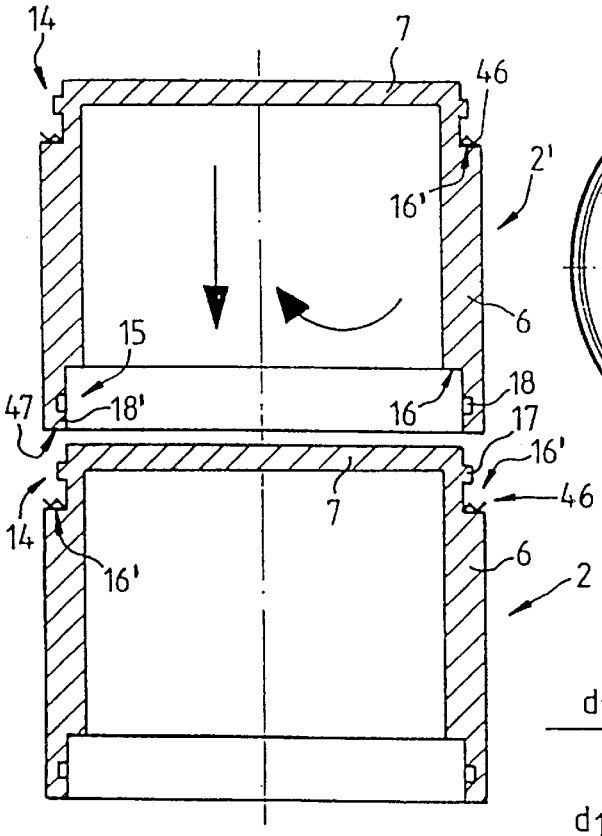

In FIGS. 3*a*–3*d*, the sealing arrangement between two light elements 2, 2' is illustrated in greater detail. Here, FIG. 3*a* shows the annular shoulder 16' on the outer surface of the light elements 2, 2'. An annular seal 46 made of a thin plastic film is laid on this annular shoulder. This film is selected according to optimum sliding properties, i.e. by using a plastic such as Teflon or the like, for example, so that the end counterflange 47 of the upper light element 2' (illustrated in FIG. 3*a*) can easily slide on the seal 46 as the rotary movement in the bayonet closure is carried out.

The plastic seal 46 is illustrated in a side view in FIG. 3*b* and in a plan view in FIG. 3*c*. The detail X of the seal 46 from FIG. 3*b*, i.e. a section along the sectional line 3*d*—3*d* in FIG. 3*c*, is represented in FIG. 3*d*.

Figure 3D:
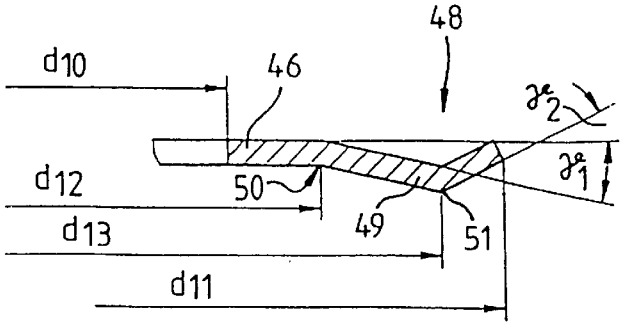

In order to give the sealing arrangement 46 a certain prestress, it is profiled according to the illustration in FIG. 3*d* or constructed with a slight degree of impression, which improves the sealing properties. This impressed area 48 comprises a V-shaped depression 49 with an angle $\gamma_1 \cong 13°$ which drops away toward the outer end and an angle $\gamma_2 \cong 27°$ which increases again in the outer area, in each case measured with respect to the horizontal as illustrated in FIG. 3*d*. In the exemplary embodiment of a seal 46, for example the inner diameter $d_{10}=63.5$ mm and the outer diameter $d_{11} \cong 67.9$ mm. The radially inner bending point 50 of the impressed area 48 lies in a diameter region $d_{12} \cong 65$ mm. The lower bending point 51 of the V-shaped depression 49 lies at a diameter $d_{13} \cong 66.9$ mm.

Of course, these diameter regions may vary according to the exemplary embodiment. The V-shaped impressed area 48, as a result of which the seal has a certain prestress which has to be overcome when the two light elements 2, 2' are pressed together, is of decisive significance. Consequently, in the assembled state, the seal 46 is pressed into a virtually planar surface, i.e. the angles $\gamma_1$, $\gamma_2$ approach zero.

Figure 4A:
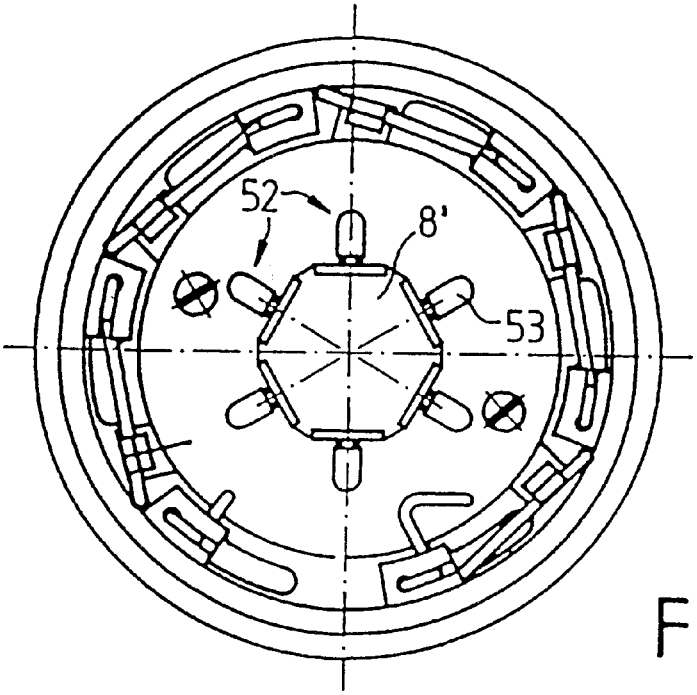
FIGS. 4*a*, 4*b* show a second exemplary embodiment with LED display as a rotating light.
Figure 4B:
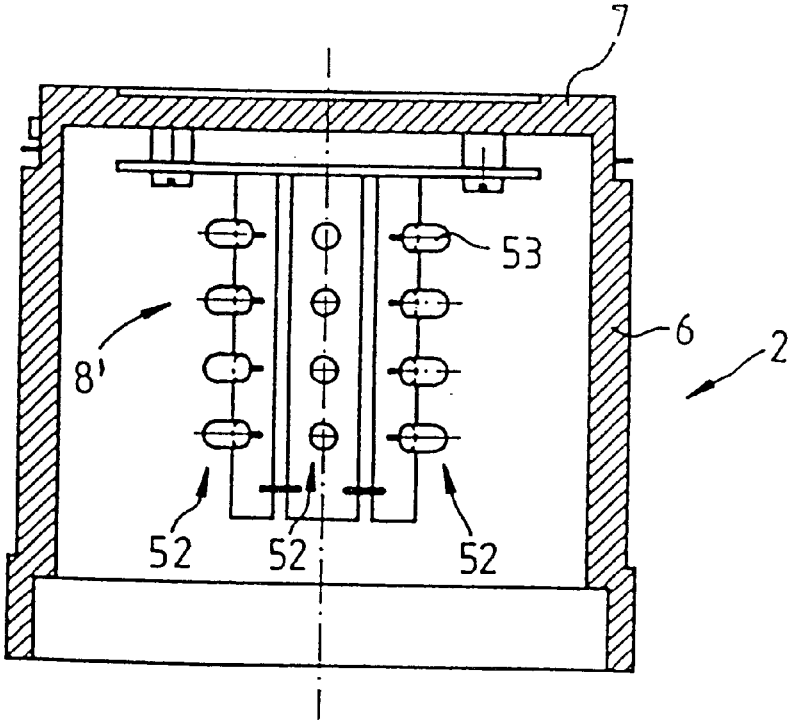

A further exemplary embodiment of the invention is shown by the illustration according to FIGS. 4*a*, 4*b*. As previously indicated, not only lights, but also a flashlight, flashing light, buzzer, horns or even voice outputting elements may be used as signal transmitters. In particular, even a so-called LED pillar 52 may be used as a light means in order to produce a kind of rotating beacon. Here, for example four LEDs 53 may be arranged vertically one on top of the other in order to form for example six LED pillars 52. Here, LEDs with a small radiation angle are used so that a concentrated light beam is produced. In a preferred exemplary embodiment, the arrangement of six pillars in a hexagon has proven expedient. Of course, other arrangements of pillars may be selected in order to produce a rotating beacon effect. The pillars are actuated cyclically one after the other so that the viewer has the impression of a rotating light. So that the movement becomes apparently "round", at the transition from one column to the next both adjacent columns are briefly actuated.

The advantage of such an LED arrangement is that the overall size can be kept very small, which is not possible without difficulty when there is a motor drive. There are no components which are subject to wear. Furthermore, a high degree of resistance to vibration can be achieved.

It is also conceivable that, instead of the LEDs, even incandescent lamps are used provided they exhibit the necessary stability.

The arrangement according to the invention is not restricted to the exemplary embodiment illustrated and described. Instead, it comprises all modifications apparent to the person skilled in the art within the scope of the patent claims.

What we claimed is:

1. A signal pillar comprising:

a plurality of signal elements (2, 2') which are essentially identical in design and which have connection means (13, 13') for connecting the signal elements (2, 2') one on top of the other, wherein each signal element (2, 2') includes an optical or audible signal transmitter (9), a hollow component (6) for holding the signal transmitter (9), and electrical connecting elements (12) which serve to supply the signal elements (2, 2') with power individually, and wherein the electrical connecting elements (12) are constructed as wires which each have a generally U-shaped connecting bridge (27) at a first end and a bent connecting leg (31) at a second end, the connecting bridge (27) of one of the signal elements interacting with the connecting leg (31) of an adjacent signal element in a frictional and resiliently sprung fashion when two adjacent signal elements (2, 2') are connected.

2. The signal pillar as claimed in claim 1, wherein the optical and/or audible signal transmitter (9) comprises a device selected from the group consisting of an incandescent lamp, a flashing light, a flash tube, a flashlight, a buzzer, horn and a voice module.

3. The signal pillar as claimed in claim 1, wherein the signal transmitter (9) comprises LED pillars which are actuated to simulate a rotating beacon.

4. The signal pillar as claimed in claim 1, wherein the hollow component (6) of each signal element (2, 2') is generally cylindrical in shape and has two ends, one end being generally open and the other end being generally closed, and wherein the connection means (13, 13') comprises a cylindrical inner flange (15) with an internal diameter $d_3$ and a height $h_1$ at the generally open end and a cylindrical outer flange 14 with an outer diameter $d_2$ at the generally closed end the diameter $d_2$ approximately matching the diameter $d_3$, and bayonet closure means for locking adjacent signal elements (2, 2') together by rotation after the inner flange (15) of one has been engaged with the outer flange (14) of the other.

5. The signal pillar as claimed in claim 4, wherein the U-shaped connecting bridge (27) is arranged in the region of the cylindrical inner flange (15) of the cylinder component (6) so as to be freely movable approximately over its height $h_1$.

6. The signal pillar as claimed in claim 1, wherein the hollow component (6) is generally cylindrical in shape and comprises a baseplate (7) with peripheral recesses (34) and tangentially running slots (35) for the U-shaped connecting bridges (27) to pass through and for their displacement.

7. The signal pillar as claimed in claim 1, wherein the U-shaped connecting bridge (27) has a shorter leg (29) and a longer leg (26), and wherein the hollow component (6) is generally cylindrical in shape and comprises a radially inwardly pointing support web (11), the shorter leg (29) being connected in a fixed fashion on the supporting web (11) and the longer leg (26) being mounted in a loose fashion with radial play.

8. The signal pillar as claimed in claim 1, wherein the bent connecting leg (31) is generally L-shaped and has a corner region (44). wherein the U-shaped connecting bridge (27) includes a pair of outer legs (29, 26) and a connecting leg (28) which connects the outer legs (29, 26), wherein, when two adjacent signal elements (2, 2') are connected together, the connecting leg (28) of the U-shaped connecting bridge (27) of one connecting elements (12) comes to rest approximately next to the corner region (44) of the L-shaped connecting leg (31) of another connecting element (12), and wherein, when rotary movement through a rotary angle $\alpha 1$ is carried out, the U-shaped connecting bridge (27) comes to rest with both outer legs against the L-shaped connecting leg (31) in a frictional fashion.

9. The signal pillar as claimed in claim 1, wherein the hollow component (6) comprises a supporting web (32) and a baseplate (7), and wherein the connecting leg (31) has a free end portion that is held by the supporting web (32) and/or is attached in the baseplate (7) via a bent section (33).

10. The signal pillar as claimed in claim 4, wherein, the bayonet closure means is disposed between the cylindrical inner flange (15) and the cylindrical outer flange (14) on the outer surface of the inner flange (15), and comprises axial insertion grooves (18') for radially protruding guide noses (7), the axial insertion grooves (18') being provided on the outer surface of the outer flange (14) of the adjacent light element, and wherein, after insertion into the axial insertion grooves, the guide nose (17) can be inserted into tangential grooves (18) over a rotary angle range $\alpha 1$, axial prestressing of the signal elements (2, 2') taking place owing to an axially rising tangential groove (18).

11. The signal pillar as claimed in claim 1, wherein each of the hollow components (6) has an annular radial fitting-on shoulder (16, 16') and further comprising an annular profile seal (46) which comprises a slidable plastic with low tangential friction on one of the fitting-on shoulders (16, 16') when two adjacent signal elements (2. 2') are connected, and wherein the profile seal (46) has an impressed area (48, 49) that is V-shaped in cross section.

12. The signal pillar as claimed in claim 10, wherein at least one tangential groove (18') of the bayonet closure means has a radial surface section (19) which rises in a slope shape and falls again and over which tangential groove (18') a radially flexible cam (21) on the outer flange (14) of the adjacent signal element slides in order to bring about locking, the cam (21) being constructed to be radially movable by virtue of two parallel slots (45) which penetrate the wall thickness of the outer flange (14) and are aligned tangentially with respect to one another.

13. The signal pillar as claimed in claim 6, wherein each signal element (2, 2') further comprises two conductor lugs (23, 24) which lead to the connection of the signal transmitter (9) and which are attached to the baseplate (7) of the signal element (2, 2'), a first electrical connecting line (12') which comes from a U-shaped connecting bridge (27) leading to a first one of the conductor lugs (23) and from there to an adjacent U-shaped connecting bridge (27') offset by a rotary angle $\alpha 1$, of the adjacent signal element and from there to the same conductor lug (23) of the adjacent signal element, and an electrical connecting line (40) leading from a U-shaped connecting bridge (27"), adjacent to the connecting bridge (27), of the first signal element (2), to the a second one of the conductor lugs (24).

14. The signal pillar as claimed in claim 1, further comprising a cable connection base (3) having connection means for connection to a terminal one of the signal elements (2, 2') in a way analogous to the connection of two signal elements (2, 2'), the cable connection base (3) additionally having means (42) for electrically contacting the U-shaped connecting bridges (27) of the electrical connection elements (12) of the terminal one of the signal elements (2, 2').

15. The signal pillar as claimed in claim 3, wherein the LED pillars (52) are arranged in a plurality of parallel columns and are actuated cyclically one after the other.

16. The signal pillar as claimed in claim 1, wherein the hollow component (6) has a generally cylindrical shape and the U-shaped connecting bridge (27) lies in a plane that is aligned approximately parallel to a line tangent to the hollow component (6).

17. A signal pillar, comprising:

a plurality of signal elements (2, 2') which are essentially identical in design and which have connection means (13, 13') for connecting the signal elements (2, 2') one on top of the other as a result of relative rotation through an angle $\alpha 1$, wherein each signal element (2, 2') includes an optical or audible signal transmitter (9), a hollow component (6)

for holding the signal transmitter (9), and electrical connecting elements (12) which serve to supply the signal elements (2, 2') with power individually, wherein the electrical connecting elements (12) are constructed as wires which each have a generally U-shaped connecting bridge (27) at a first end and a bent connecting leg (31) at a second end, the connecting bridge (27) of one of the signal elements interacting with the connecting leg (31) of an adjacent signal element in a frictional and resiliently sprung manner when two adjacent signal elements (2, 2') are connected, wherein the U-shaped connecting bridge (27) has a pair of outer legs (29, 26), and wherein, when relative rotation through the angle $\alpha 1$ is being carried out during connection of adjacent signal elements (2, 2'), the U-shaped connecting bridge (27) comes to rest with both its outer legs against the connecting leg (31) in a frictional fashion.

18. The signal pillar as claimed in claim 17, wherein the connecting leg (31) is generally L-shaped.

19. The signal pillar as claimed in claim 17, wherein the hollow component (6) has a generally cylindrical shape and the U-shaped connecting bridge lies in a plane that is aligned approximately parallel to a line tangent to the hollow component (6).

20. A signal pillar, comprising:

a first signal element which includes a first hollow housing having upper and lower ends, a first lamp mounted in the first housing, a plurality of first electrical connecting elements, the first electrical connecting elements having upper and lower end portions, and means for connecting the first lamp to at least some of the first electrical connecting elements; and a second signal element which includes a second hollow housing having upper and lower ends, a second lamp mounted in the second housing, a plurality of second electrical connecting elements, the second electrical connection elements having upper and lower end portions, and means for connecting the second lamp to at least some of the second electrical connecting elements, wherein the upper end of the first housing and the lower end of the second housing having means for connecting the housings when they are rotated relative to one another from an initial position to a final position, the upper end portions of the first electrical connecting elements and the lower end portions of the second electrical connecting elements being moved relative to one another during rotation of the housings and being pressed against one another when the housings are in their final position.

21. A signal pillar as claimed in claim 20, wherein the first and second signal elements are substantially identical.

22. A signal pillar as claimed in claim 20, wherein the first and second electrical connecting elements are made of springy wire with a round cross section.

23. A signal pillar as claimed in claim 20, wherein the upper end portions of the first and second electrical connecting elements comprise wire segments that are disposed generally horizontally.

24. A signal pillar as claimed in claim 23, wherein the lower end portions of the first and second electrical connecting elements are generally U-shaped.

* * * * *